US006430460B1

(12) United States Patent
Taguchi

(10) Patent No.: US 6,430,460 B1
(45) Date of Patent: Aug. 6, 2002

(54) SEWING DATA PROCESSING APPARATUS AND PROGRAM STORAGE MEDIUM

(75) Inventor: Shoichi Taguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/472,853

(22) Filed: Dec. 28, 1999

(30) Foreign Application Priority Data

Jan. 14, 1999 (JP) ..... 11-007633

(51) Int. Cl.[7] ..... D05C 5/02

(52) U.S. Cl. ..... 700/138; 112/102.5; 112/445

(58) Field of Search ..... 700/138, 136, 700/137; 112/102.5, 470.06, 475.19, 445, 470.04

(56) References Cited

FOREIGN PATENT DOCUMENTS

JP A-7-334691 12/1995

*Primary Examiner*—Peter Nerbun
(74) *Attorney, Agent, or Firm*—Oliff & Berridge, PLC

(57) ABSTRACT

On the sewing data making screen, a thread thickness to be displayed is set by specifying a thread number that is used for actual sewing in a thread thickness setting dialogue box. A magnification rate to display a created sewing data on a display is set in a magnification setting dialog box. When an image button is specified with a mouse pointer on the screen, a displaying size of thread used in the sewing data is calculated so that it can become suitable for the magnification rate. As a result, an image substantially like that of the pattern when actually sewn will be displayed as a realistic image on the display screen.

24 Claims, 14 Drawing Sheets

SEWING DATA PROCESSING APPARATUS AND PROGRAM STORAGE MEDIUM

BACKGROUND OF THE INVENTION

1. Field of Invention

The invention relates to a sewing data processing apparatus and a program storage medium that stores a sewing data processing program and, in particular, to a sewing data processing apparatus capable of displaying sewing data created thereon as an image using suitable thick lines corresponding to a thickness of the thread to be used for actual sewing in accordance with a magnification rate of the display, to accurately represent the appearance of the stitches when the sewing data is magnified.

2. Description of Related Art

In a conventional sewing data processing apparatus, which is comprised of a personal computer, it is arranged that each of sewing data for a desired stitch pattern or embroidery pattern is created on a display using a mouse (or other coordinate input device or means, such as the arrow keys on a keyboard or a touch or light stylus). That is, various patterns and figures, such as a flower or an animal, are drawn on a sewing data making screen by moving a mouse pointer to a desired position on the display using the mouse (in this example) and clicking successively to define needle positions, and sewing data is created based on these patterns and figures. Sewing data can be also created from a figure which has been scanned through an image reading device, such as an image reader, and edited on the sewing data making screen.

The sewing data making screen allows a part of the sewing data created thereon to be magnified, thereby enabling the operator to confirm thread density among stitches in the part shown on the display. In this case, the part is specified using the mouse, and it can be displayed in a desired enlarged view, for example, 120% or 180%. When the sewing data is displayed in the enlarged view, it is noted that just the sewing area or pattern size of the sewing data is enlarged. Whatever the magnification rate is set to, the thread representing each stitch of the sewing data is indicated with a fixed thickness, for example, a thin line with a width of a single dot.

On the other hand, a recent commercially available sewing data processing apparatus is one where a user can change the thickness of thread representing stitches in a pattern to a desired thickness on the display.

However, in the apparatus of this kind, the thread thickness displayed on the display is not automatically adjusted even if the magnification rate of the sewing data is changed. In order to display the sewing data on this apparatus so that the operator can imagine the results after it is sewn, the operator must determine how many dots are required to represent the thread thickness on the display if the magnification rate is changed, and set the number of dots in the apparatus. Because of this, when the operator wants to see all of the sewing data in an enlarged view or a part of the sewing data in a further enlarged view, the operator has to determine and reset the thread thickness every time the magnification rate is changed. This operation really annoys the operator.

SUMMARY OF THE INVENTION

The invention was made in consideration of the above circumstances. Therefore, the objects of the invention are to display sewing data for a stitch pattern or embroidery pattern created on the apparatus as an image as closely as possible to what will actually be sewn; to display stitches with suitable thick lines corresponding to a display magnification rate with a simple operation; and to reset the changed thread thickness and magnification rate to their default values easily.

A sewing data processing apparatus described in embodiments of the invention to accomplish these objects comprises a display, a thread thickness selecting device that selects a thread thickness of a thread used for forming a sewing pattern, a displaying magnification setting device that sets a displaying magnification of the sewing pattern on the display, a calculating device that calculates a displaying size of the thread on the display based on the thread thickness selected by the thread thickness selecting device and the displaying magnification set by the displaying magnification setting device, a display controller that displays the sewing pattern with the thread in the displaying size calculated by the calculating device on the display.

The thread thickness to be set on the display is selected via the thread thickness setting device by inputting a thread number or thread diameter. A magnification rate to display a pattern in a desired size is selected, such as 120% and 180%, via the displaying magnification setting device. A size of the image of the thread is determined in the calculating device, based on the thread thickness determined in the thread thickness setting device and the magnification rate determined in the displaying magnification setting device. Namely, thread in the image of the created sewing data can be displayed with a suitable thickness which is found as a result of the calculation. If the magnification rate is changed, thread can be displayed with a suitable thickness in accordance with the change in the magnification rate. Thus, the operator can view the finished result (especially thread density) of the actual sewn pattern on the display just by predetermining the thread thickness, no matter how the magnification rate is changed.

In a preferred aspect of the invention, the sewing data processing apparatus further comprises a default thickness storing device that stores a default thickness of the thread and a thread thickness resetting device that resets a setting of the thread thickness to the default thickness of the thread stored in the default thickness storing device.

Therefore, if the thread thickness is changed via the thread thickness setting device, it can be easily reset to the default value via the default thickness storing device. In this aspect, it is desirable that the sewing data processing apparatus further comprises a default thickness setting device that sets the thickness of the thread used for the sewing data being processed as a default thickness. Because the thread thickness currently set in the sewing data can be set as the default immediately, the operation for a default setting becomes very simple.

In another preferred aspect of the invention, the sewing data processing apparatus further comprises a default displaying magnification storing device that stores a default displaying magnification, and a displaying magnification resetting device that resets a setting of the displaying magnification of the thread to the default displaying magnification stored in the default displaying magnification storing device.

Therefore, if the magnification rate is changed via the displaying magnification setting device, it can be easily reset to the default value via the displaying magnification resetting device. In this aspect, it is desirable that the sewing data processing apparatus further comprises a default displaying magnification setting device that sets the displaying magnification of the thread used for the sewing data being processed as a default magnification rate. Because the magnification rate currently set in the sewing data can be set as the default immediately, the operation for a default setting becomes very simple.

In a further preferred aspect of the invention, the displaying magnification setting device sets a displaying magnification of a desired sewing pattern. Therefore, the operator can see a specific part of the sewing pattern in an enlarged view to check the finished results, such as thread density in detail.

In another preferred aspect of the invention, the displaying magnification setting device sets a displaying magnification of an entire sewing area. Therefore, the operator can confirm a general view of the sewing data by changing the displaying magnification of the entire area.

In another embodiment of the invention, a computer-readable storage medium stores a sewing data processing program for processing sewing data using an electronic processor and a display. The sewing data processing program includes a thread thickness selecting routine for selecting a thread thickness of a thread used for forming a sewing pattern, a displaying magnification setting routine for setting a displaying magnification of the sewing pattern on the display, a calculating routine for calculating a displaying size of the thread on the display based on the thread thickness and the displaying magnification, and a display controlling routine for displaying the sewing pattern with the thread in the calculated displaying size on the display.

In the embodiment, the effects similar to those of the above-described aspects can be obtained.

BRIEF DESCRIPTION OF THE DRAWINGS

The invention will be described in greater detail with reference to preferred embodiment thereof and the accompanying drawings wherein.

DETAILED DESCRIPTION OF PREFERRED EMBODIMENTS

A preferred embodiment of the invention will be described in detail with reference to the accompanying drawings.

The embodiment of the invention is an example of the invention being applied to a sewing data processing apparatus that is comprised of a personal computer and enables the creation of sewing data (embroidery data) for various embroidery patterns.

Figure 1:
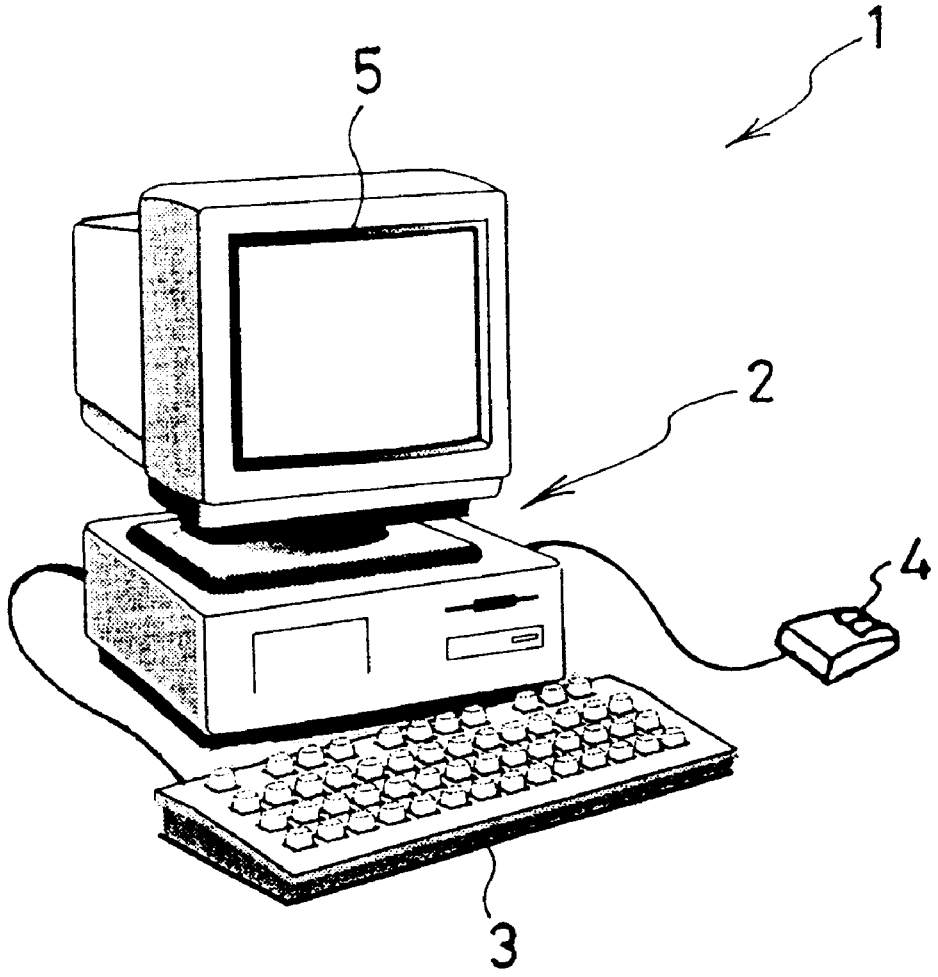
FIG. 1 is a perspective view of a sewing data processing apparatus to which the invention is applied.

As shown in FIG. 1, the sewing data processing apparatus 1 comprises a control device 2 incorporating a controller 10, a keyboard 3 having a numeric keypad and various kinds of function keys, a mouse (coordinate input device) 4, and a CRT display 5.

Figure 2:
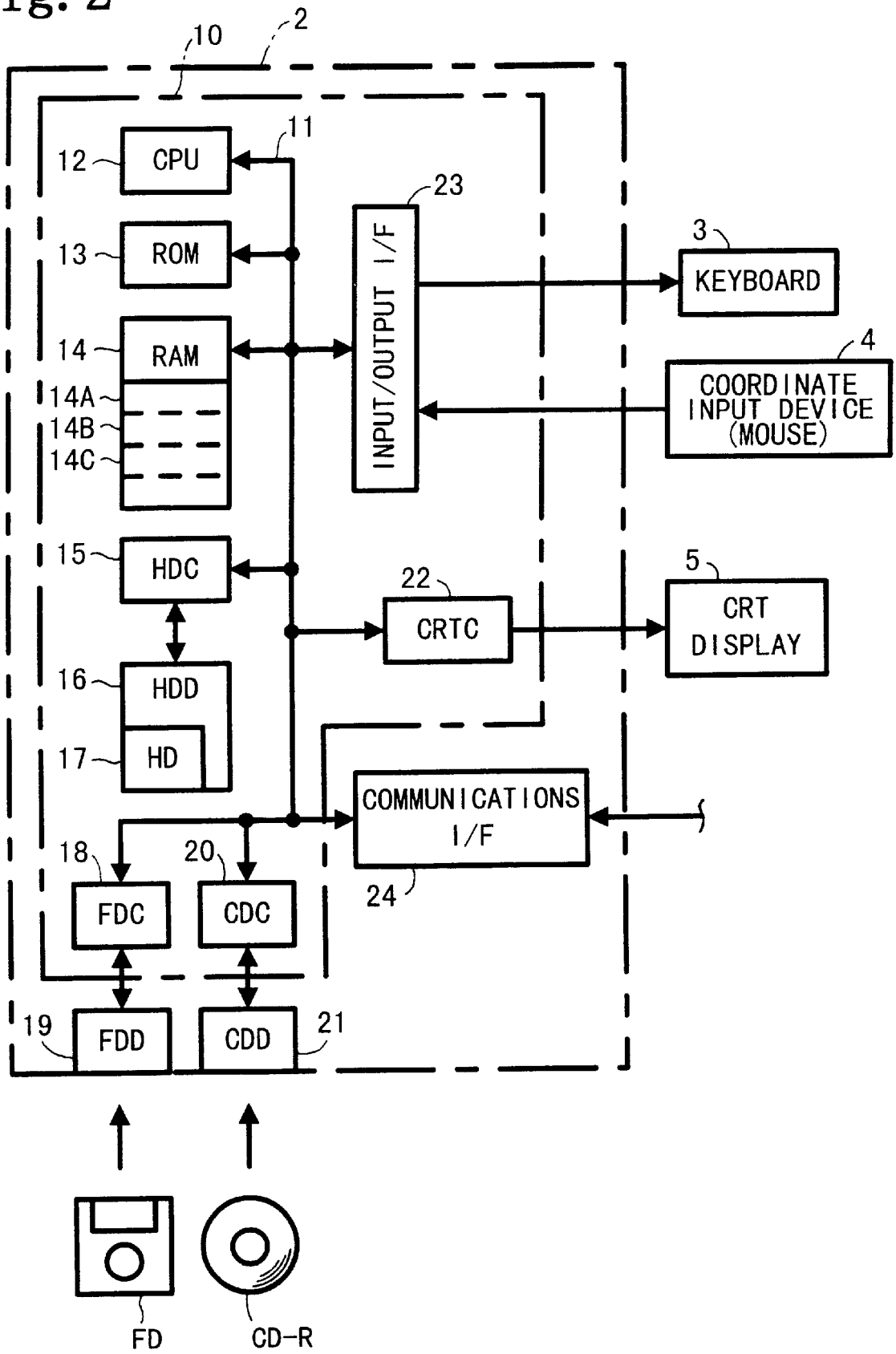
FIG. 2 is a block diagram showing a control system of the sewing data processing apparatus.

The control system of the sewing data processing apparatus 1 will now be described with reference to FIG. 2.

The controller 10, built into the control device 2, includes a CPU 12, a ROM 13, a RAM 14, a hard disk controller (HDC) 15, a hard disk drive (HDD) 16 having a hard disk (HD) 17, a floppy disk controller (FDC) 18 that controls a floppy disk drive (FDD) 19, a compact disk controller (CDC) 20 that controls a CD-R (CD recordable) drive (CDD) 21 (the CD drive could also be a recordable DVD drive), a display controller (CRTC) 22 for the CRT display 5, and an input/output interface 23, which are connected to each other via a bus 11, such as a data bus.

The input/output interface 23 is connected to the keyboard 3 and the mouse 4 (the invention is not limited to a mouse as a coordinate input device, the mouse is just exemplary), and a communications input/output interface 24 is connected to the controller 10 via the bus 11. The communications input/output interface 24 can be connected to an embroidery machine (not shown), the sewing data processing apparatus, or a communication network like the Internet (not shown). A floppy disk, FD, can be detachably inserted into the FDD 19, a compact disk recordable (CD-R) can be detachably inserted into the CDD 21, therefore, sewing data for the created patterns can be stored into the FD or CD-R.

Figure 3:
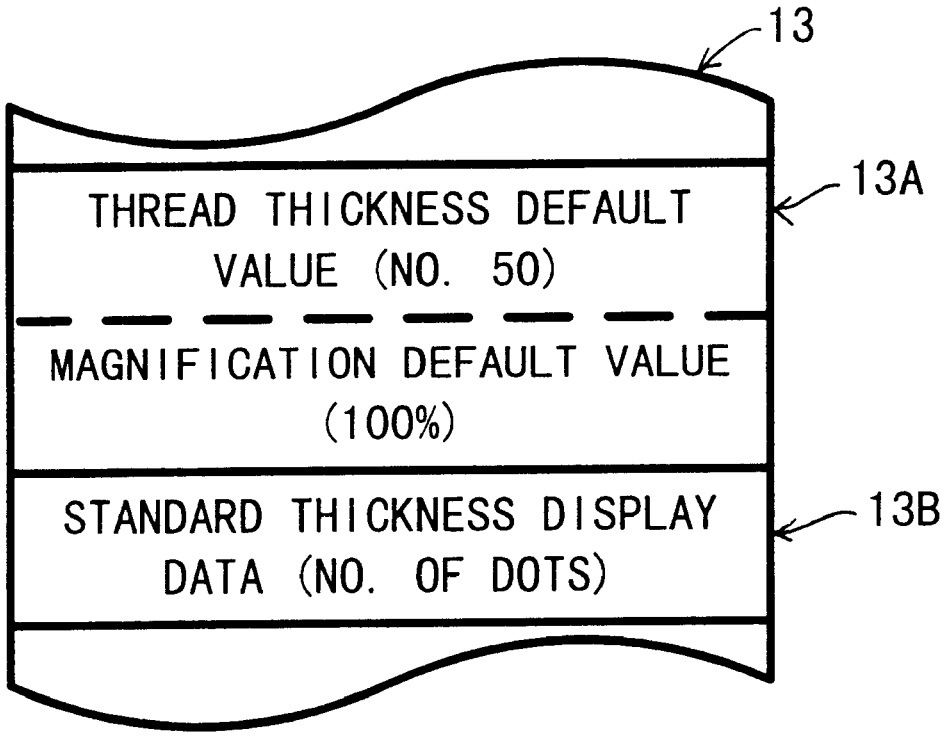
FIG. 3 shows a structure of a ROM that includes data in a default memory and a standard display thickness memory therein.

The ROM 13 stores the start control program (boot program) that is used to start up the sewing data processing apparatus 1 when the power is turned on. As shown in FIG. 3, a default memory 13*a* of the ROM 13 stores a default value for a thickness of thread to be displayed (e.g. No. 50), a default memory 13*b* stores a default value for a magnification rate (e.g. 100%), and a standard display thickness memory 13*c* stores standard display thickness data that displays the sewing data using the number of dots determined when both the thickness of thread and the magnification rate are set to the default values.

The HD 17 stores a plurality of operating systems such as the MS-DOS and Windows system, and a plurality of drivers that enable the keyboard 3, the mouse 4, and the CRT display 5 to be available on the operating systems, a communication control program to conduct data communications with external electronic equipment, a control program related to the creation of sewing data, which is peculiar to the invention for creating sewing data for various patterns like embroidery patterns, and an editing control program for editing sewing data, e.g., enlargement and reduction.

The RAM 14 stores thread thickness data to be set in a thread thickness memory 14*a*, magnification rate data to be set in a magnification rate memory 14*b*, and sewing data to be created in a sewing data memory 14*c*.

Figure 4:
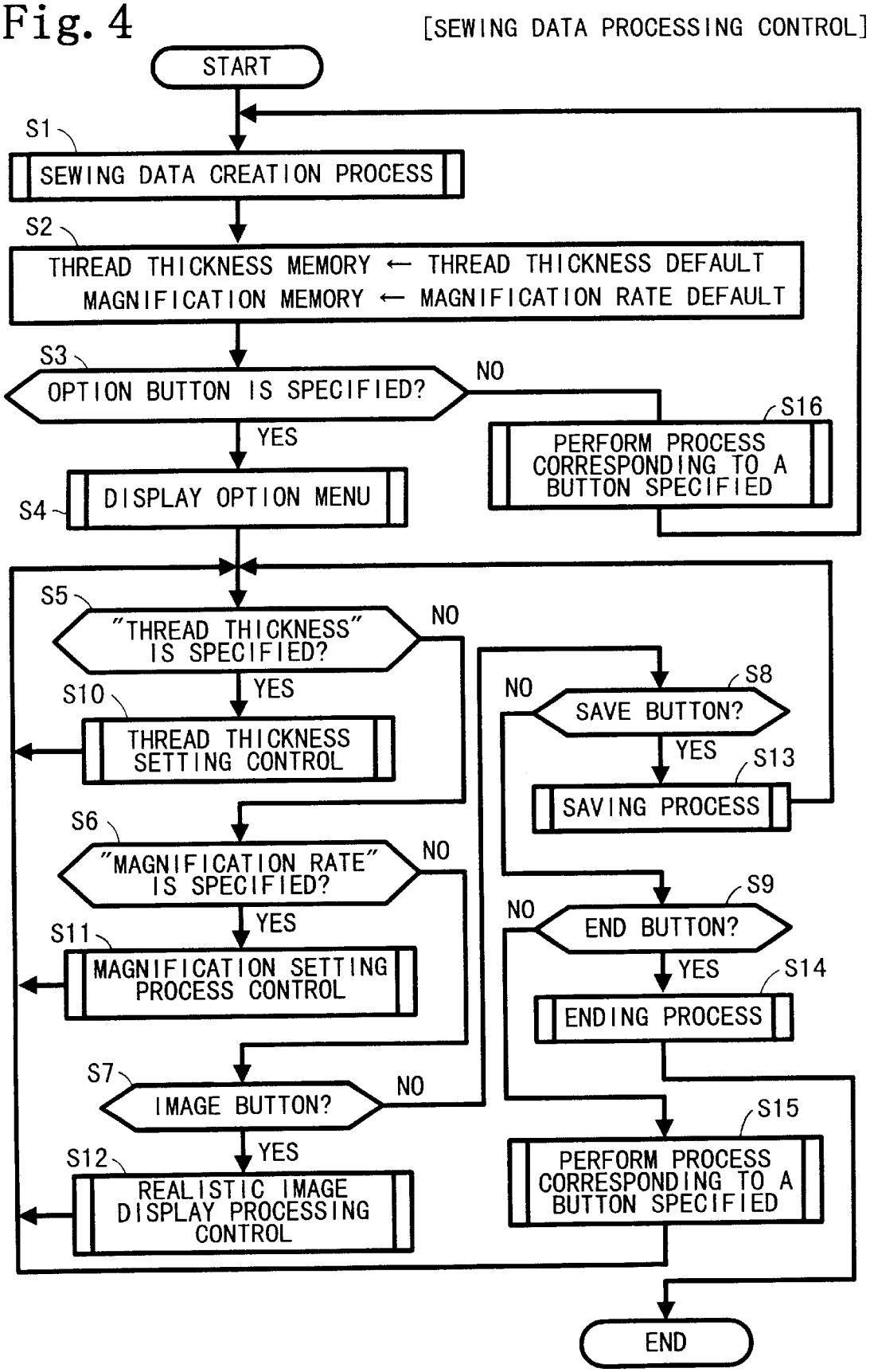
FIG. 4 is an abbreviated flowchart showing a sewing data processing control routine.
Figure 5:
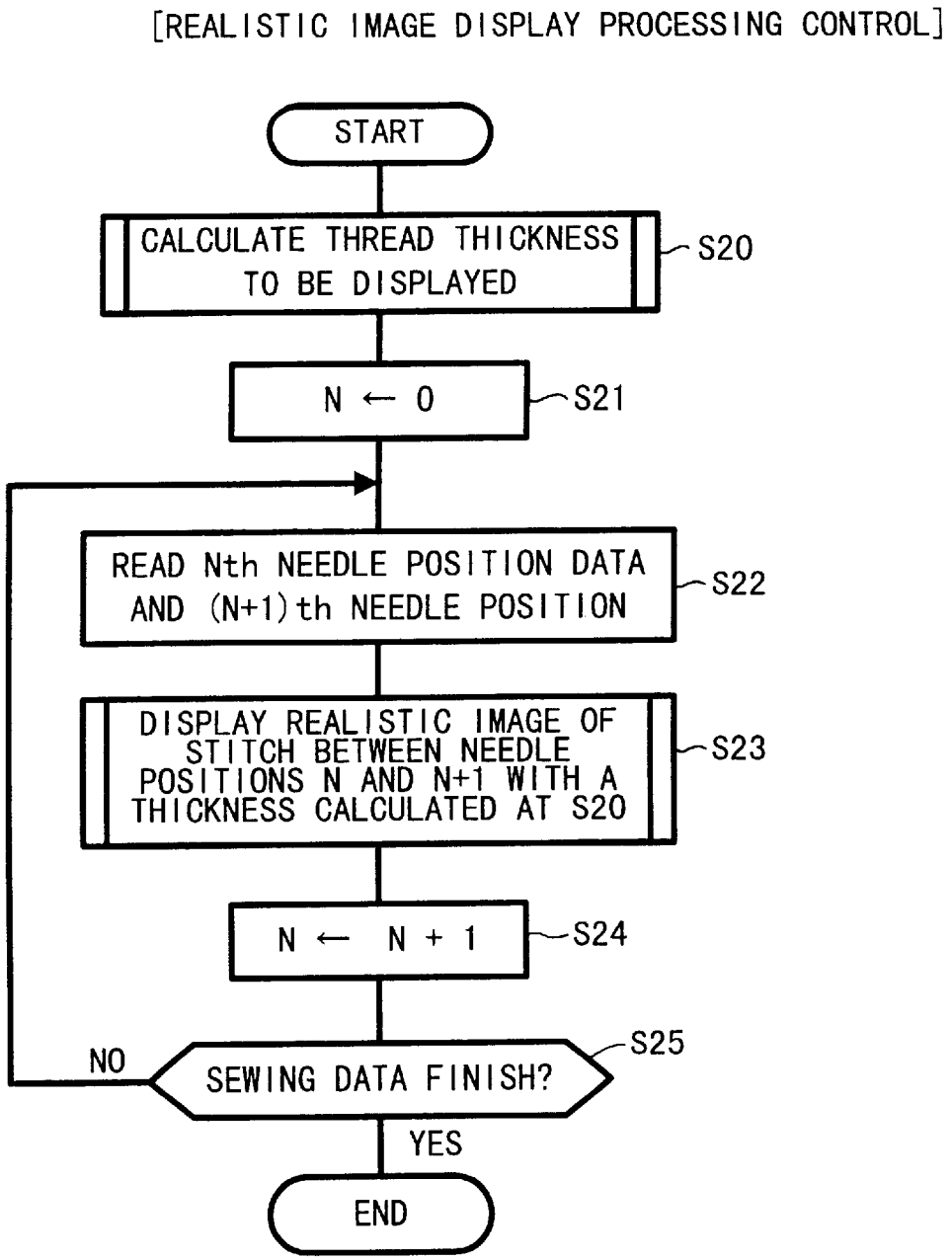
FIG. 5 an abbreviated flowchart showing a realistic image display control routine.

Next is an explanation about routines for the sewing data processing control and realistic image display control executed in the controller 10 with reference to flowcharts in FIGS. 4 and 5. In the flowcharts, Si (i=1, 2, . . . ) stands for a procedure step.

Figure 6:
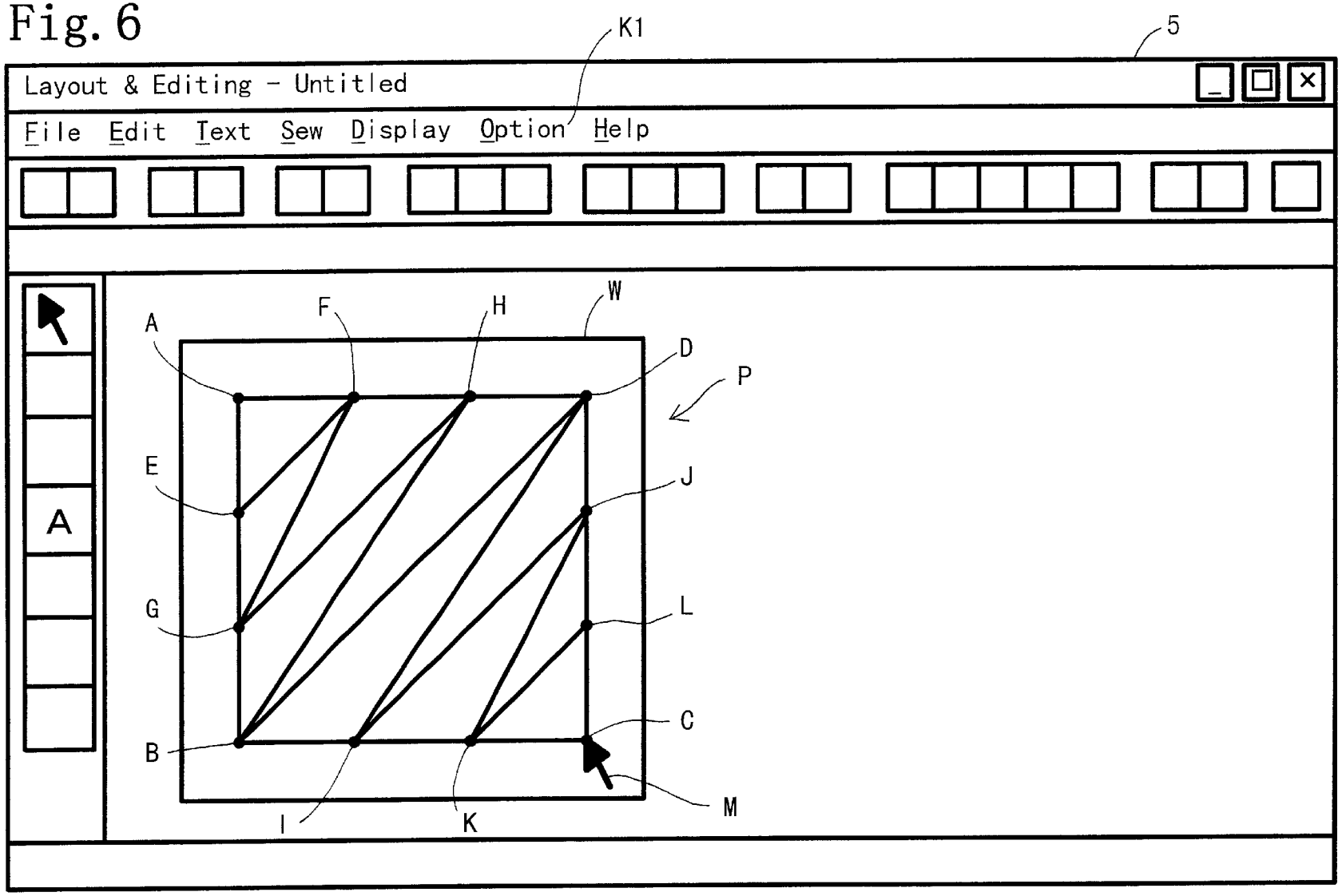
FIG. 6 shows an example of a sewing data making screen that displays a pattern.

When the sewing data processing apparatus 1 is switched on and "Create sewing data" is selected on the menu screen which appears first, the sewing data processing control is executed. As the operator draws a pattern on the sewing data making screen by moving the mouse to designate the mouse pointer M at desired positions, sewing data for the pattern is created and stored in the sewing data memory 14*c* (S1). For example, FIG. 6 shows that sewing data P is created from a plurality of needle points A to L plotted on the sewing data making screen using the mouse. The screen shows sewing area W that corresponds to a size of an actual embroidery frame.

Figure 7:
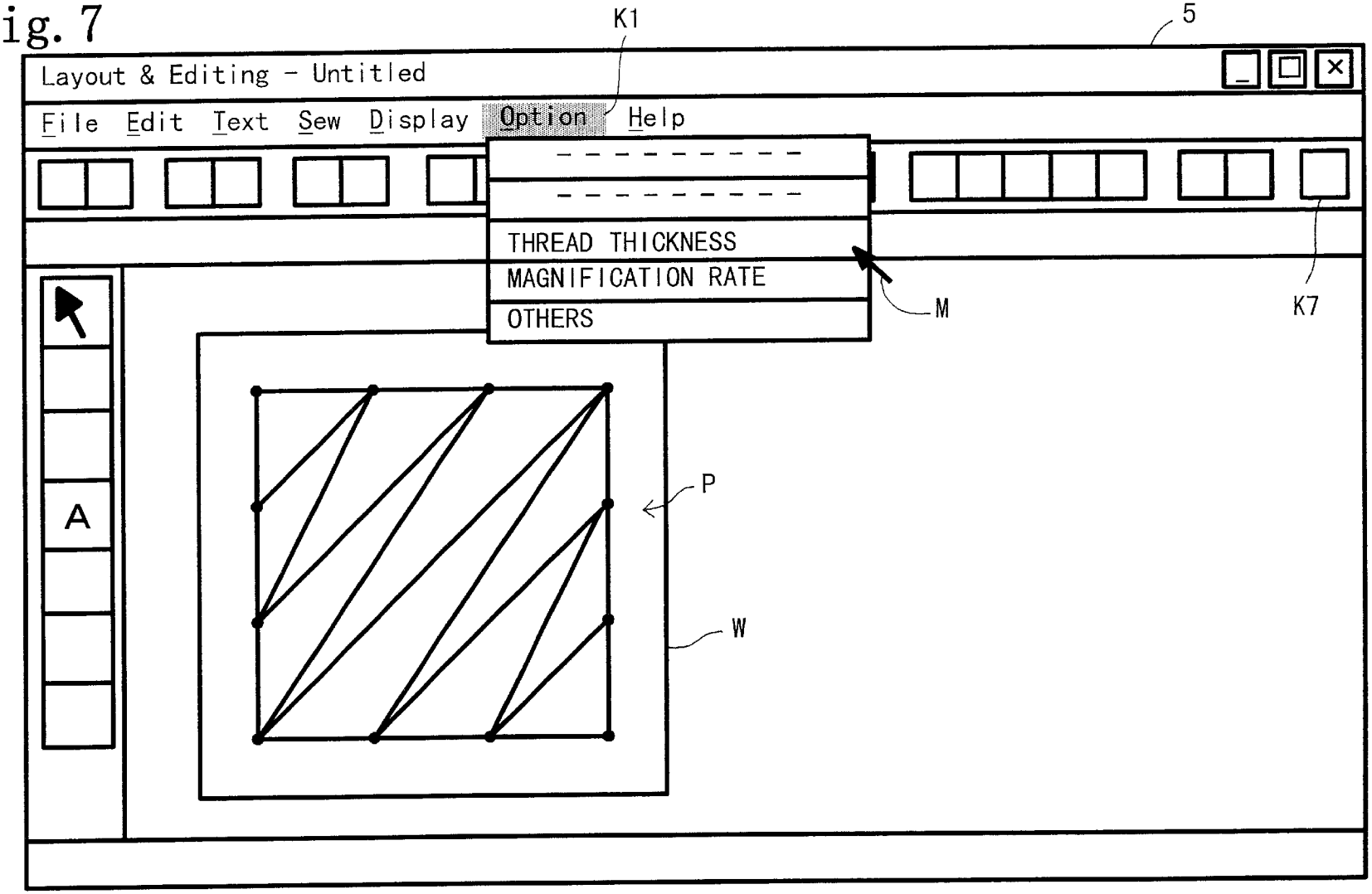
FIG. 7 shows an example of an Option Menu on the sewing data making screen.

The default values of the thread thickness (No. 50) and the magnification rate (100%) are read from the default memory 13*a* and the default memory 13*b* respectively, and defined in the thread thickness memory 14*a* and the magnification rate memory 14*b* respectively (S2). When an option button K1 is specified from the toolbar on the sewing data making screen using the mouse pointer M (S3: Yes), a pull-down option menu appears (S4). As shown in FIG. 7, for example, a plurality of optional setting items such as "Thread thickness", "Magnification rate", "Others (thread color, cloth color, thread type, etc.)" are displayed.

Figure 8:
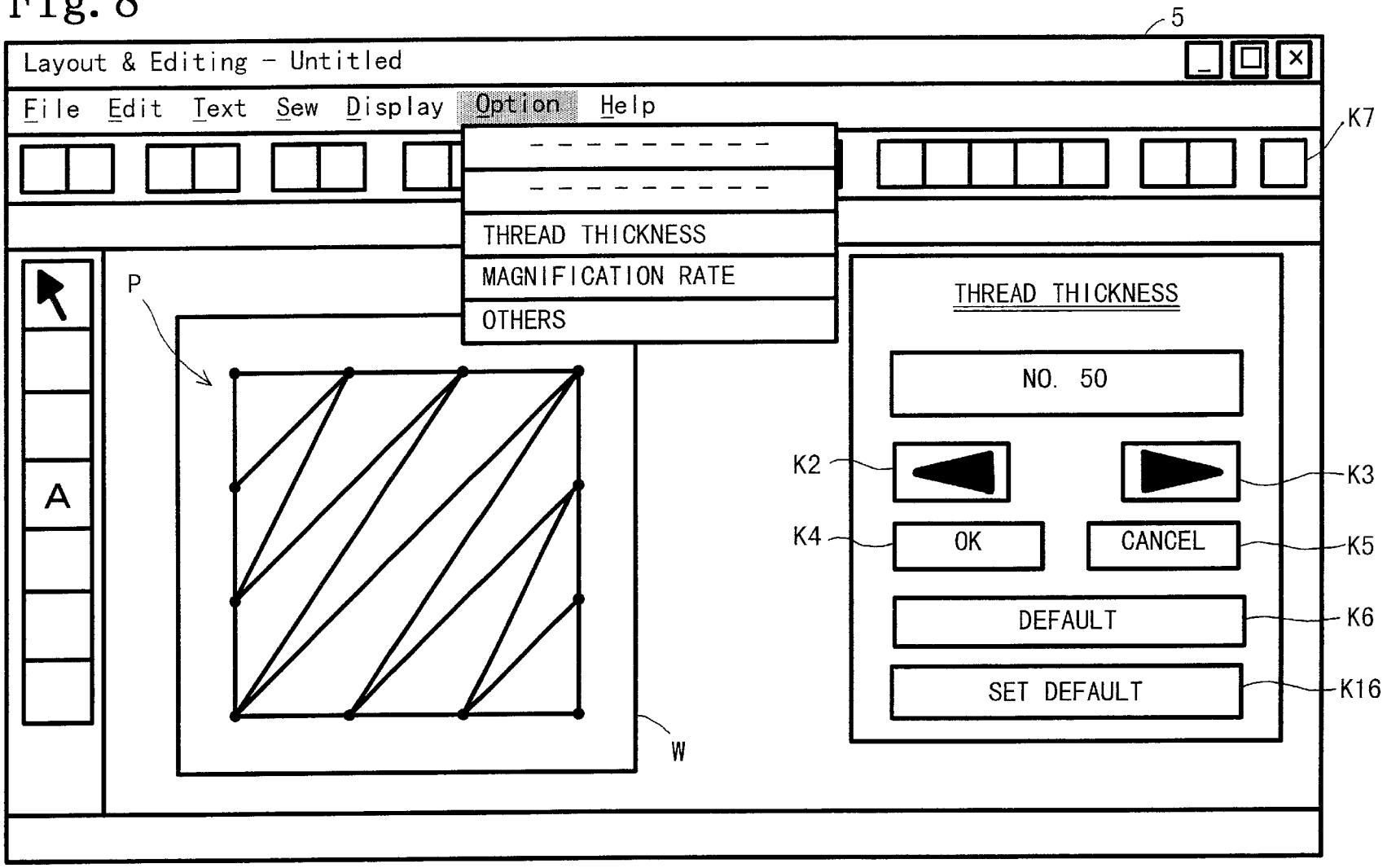
FIG. 8 shows an example of a thread thickness setting dialog box.

If "Thread thickness" is specified from the option pull-down menu using the mouse pointer M (S5: Yes), the CPU 12 executes the thread thickness setting control (S10). In the thread thickness setting control, a thread thickness setting dialog box appears first in a pop-up window as shown in FIG. 8. The screen shows thread thickness "No. 50" as the default value, a number decrease button K2, a number increase button K3, an OK button K4, a cancel button K5, and a default button K6. The thickness of thread can be set to Nos. 20 (the thickest)–80 (the thinnest), in increments/decrements of 1, which correspond to actual thread numbers.

Figure 9:
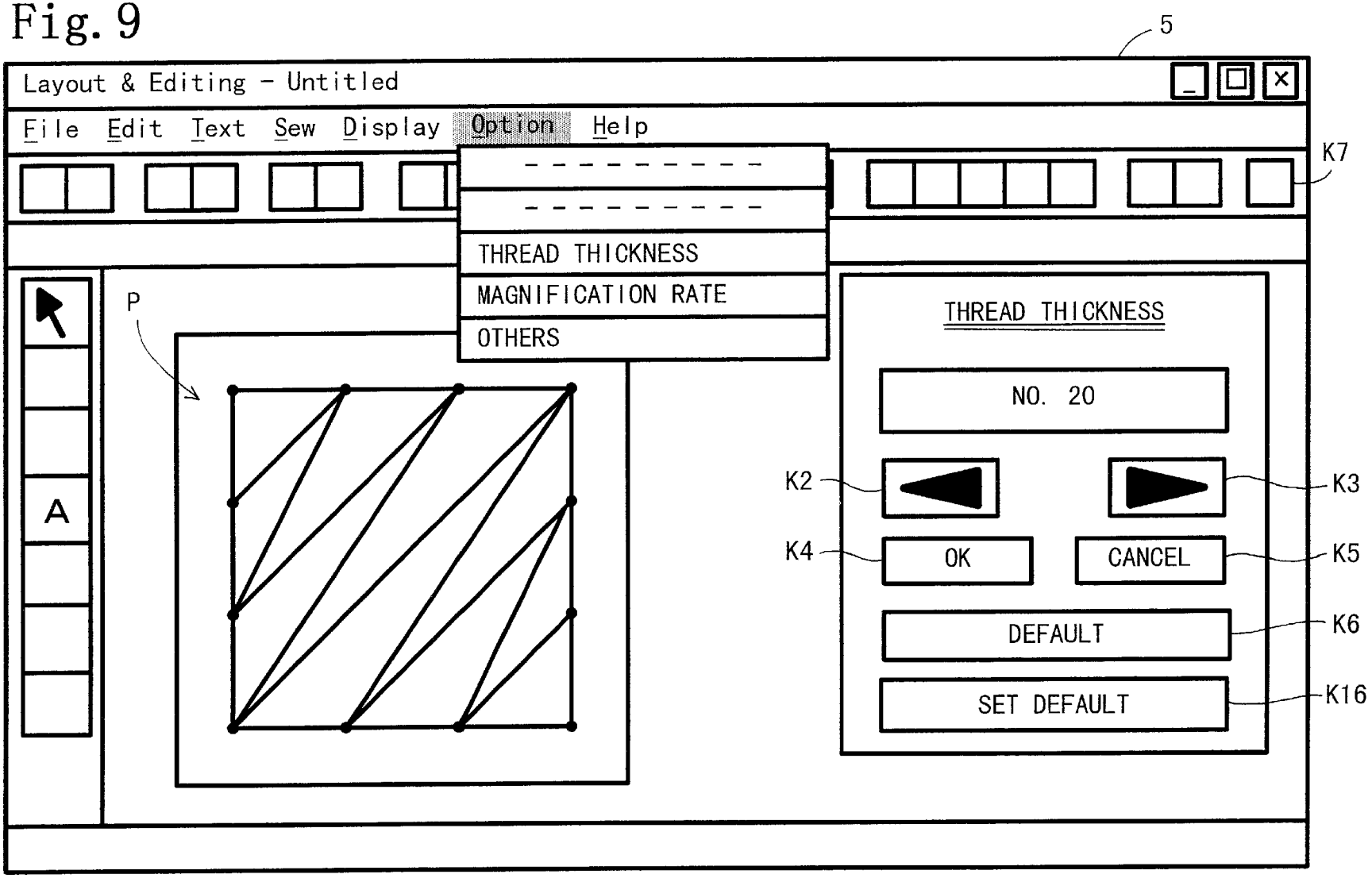
FIG. 9 corresponds to FIG. 8 when a thread thickness is set.

When the thread thickness is changed to No. 20 as shown in FIG. 9, the number increase button K3 is continuously pressed using the mouse pointer M till the thread thickness is set to No. 20. When the OK button K4 is pressed to have the thread thickness memory 14*a* store "No. 20 " as the thread thickness data, the thread thickness setting dialog box disappears. However, if the default button K6 is pressed when the thread thickness is set to No. 20, No. 50 of the default value will be overwritten in the thread thickness memory 14*a*.

Figure 10:
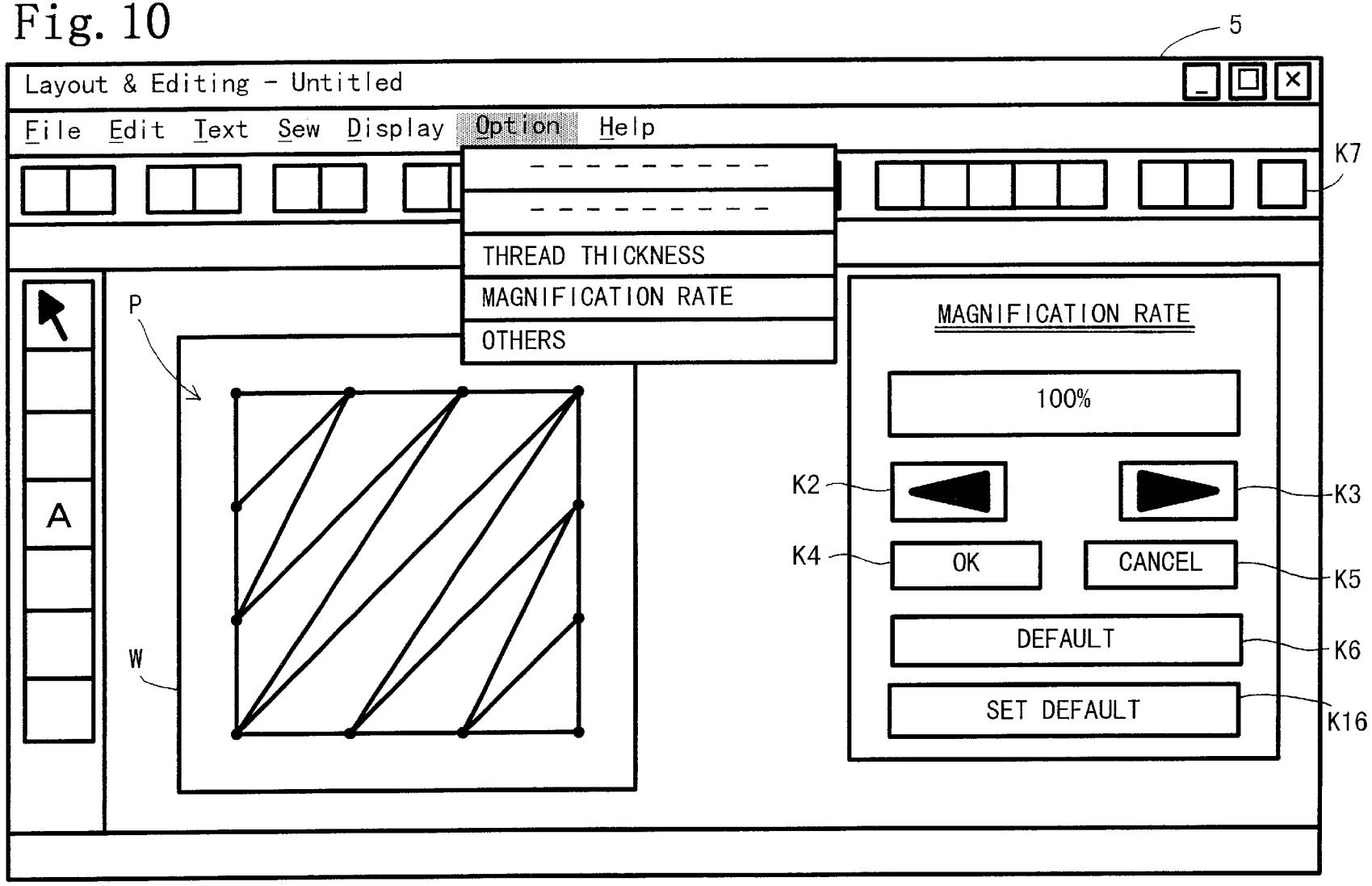
FIG. 10 shows an example of a magnification setting dialog box.

When the "Magnification rate" is specified from the option pull-down menu using the mouse pointer M (S5: No, S6: Yes), the CPU 12 executes the magnification setting process control (S11). The magnification setting process control will now be described. In the magnification setting process control, a magnification setting dialog box appears first in a pop-up window as shown in FIG. 10. The screen indicates magnification rate 100% as the default value, the number decrease button K2, the number increase button K3, the OK button K4, the cancel button K5, and the default button K6. The magnification rate can be set to 50%–250% with a unit of 1% increment/decrement.

The magnification rate setting means changes the magnification of an image on the display, it does not change the size of the sewing data.

Figure 11:
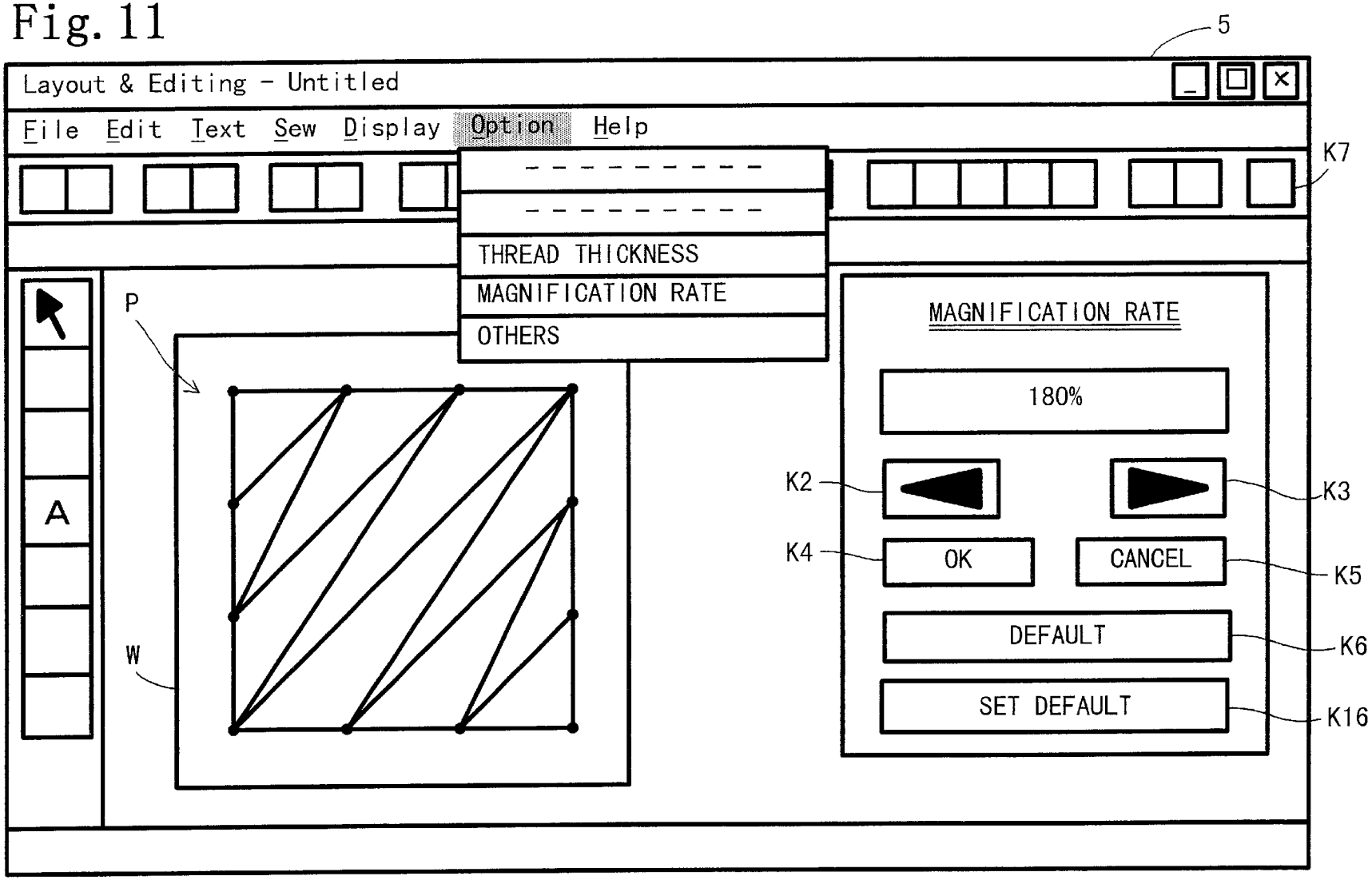
FIG. 11 corresponds to FIG. 10 when a magnification rate is set.

When the magnification rate is changed to 180% as shown in FIG. 11, the number increase button K3 is continuously pressed using the mouse pointer M till the magnification rate is set to 180%. When the OK button K4 is pressed to have the magnification rate memory 14*b* store "180%" as magnification data, the magnification setting dialog box disappears. However, if the default button K6 is pressed when the magnification rate is set to 180%, default value of 100% will be overwritten in the magnification rate memory 14*b*.

When the image button K7 is finally specified from the toolbar using the mouse pointer M (S5 and S6: No, S7: Yes), the CPU 12 executes the realistic image display processing control (S12) (Refer to FIG. 5).

In the realistic image display processing control, the thickness of thread to be displayed is calculated first (S20).

Thread thickness (number of dots) to be displayed "Z" is calculated from the formula below:

$$Z=X\times Y\times(1+(80-T)\times\alpha)$$

where X represents standard display thickness data (number of dots) stored in the standard display thickness memory 13*c*. The standard display thickness data means a thickness of the thinnest thread (No. 80) when the magnification rate is 100%. In this embodiment, X is set to 3 dots. Y represents a magnification rate number. For example, 100% is represented by 1, and 180% by 1.8. T represents a thread number. $\alpha$ represents a thread thickness coefficient. The thread thickness coefficient is a value for the rate of change of thread thickness when T is increased or decreased by one. In this embodiment, $\alpha=0.0167$.

For example, when the magnification rate 180% and the thread number 50 are set, the thread thickness to be displayed "Z" will be found to be 8 (dots) by making the following substitutions and rounding the result to the nearest whole number:

$$X=3,\ Y=1.8,\ T=50,\ \alpha=0.0167$$

Figure 12:
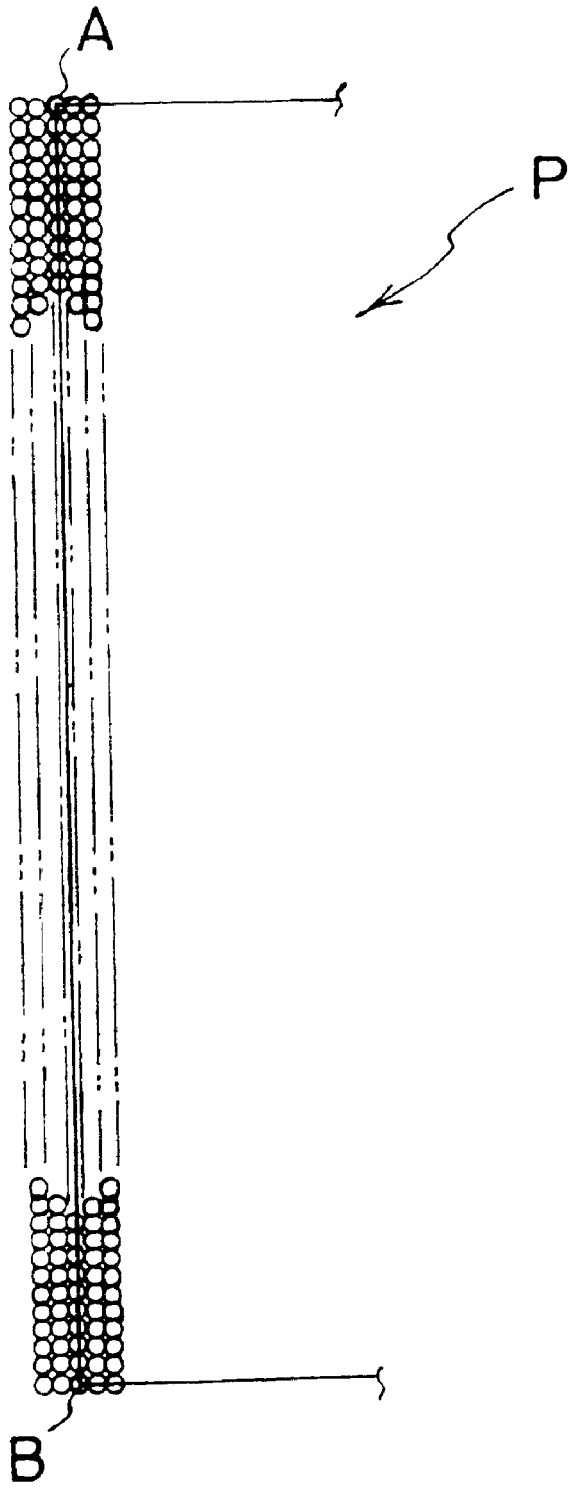
FIG. 12 shows a displaying method of one stitch based on the thread thickness data.

Then, 0 is set to counter N (S21), and the needle position data n and the needle position data n+1 are read from the sewing data stored in the sewing data memory 14*c* (S22). A realistic image of a stitch to be formed between needle position n and needle position n+1 is displayed with a thickness calculated based on the above formula (S23). As shown in FIG. 12, an example image of a stitch between a first needle position A and a following needle position B in a pattern P is represented by a line having a thickness of 5 dots, where two dots have been added to each side of a base, or single, dot that is used as the line on the sewing data making screen.

Figure 13:
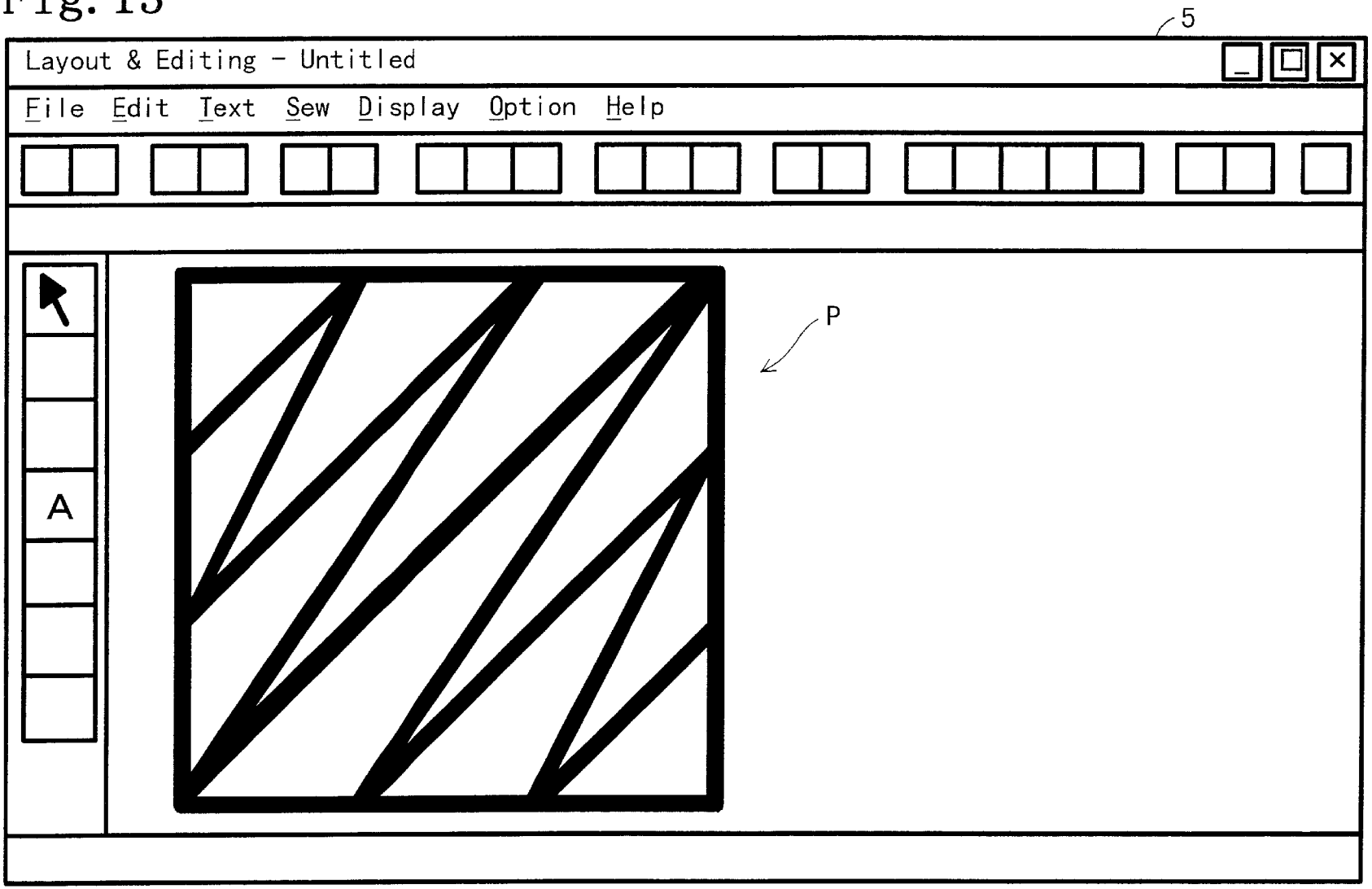
FIG. 13 shows an example of a pattern that is displayed with the set thread thickness and magnification rate.

When counter N is increased by one (S24) and the sewing data is not finished (S25: No), steps S22–25 are repeatedly performed and a realistic image of each stitch is continuously displayed one by one until the final stitch is displayed. When the realistic image of the final stitch is displayed (S25: Yes), the realistic image display control is completed, and the flow returns to S5 in the sewing data processing control. Namely, when the thread thickness is set to No. 20 and the magnification rate to 180%, the real image screen indicates the pattern P with an 11-dot thread thickness as shown in FIG. 13, thereby enabling the operator to expect the finishing results close to what will happen after the pattern is actually sewn using thread No. 20, especially to confirm whether or not the thread density is suitable for the pattern.

Figure 14:
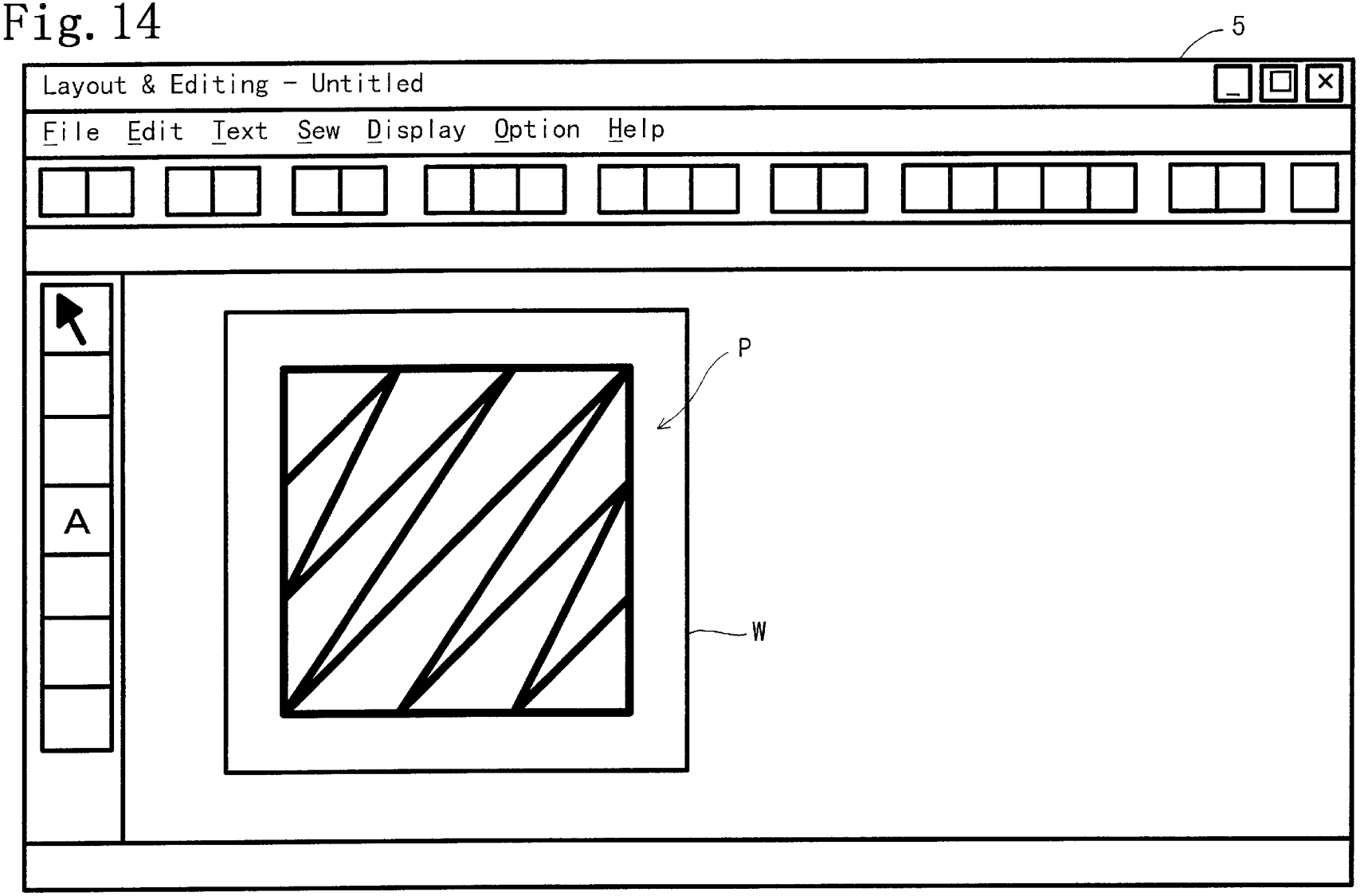
FIG. 14 shows an example of a pattern that is displayed after only the thread thickness is changed.

On the other hand, when the thread thickness is set to No. 20 and the magnification rate is reset to the default value 100%, the realistic image screen shows pattern P with a 6-dot thread thickness as shown in FIG. 14. Almost the same results can be obtained as when the pattern P is actually sewn using thread No. 20.

In the sewing data processing control, when the save button is specified in the toolbar using the mouse pointer M (S5–S7: No, S8: Yes), the CPU 12 executes the saving process (S13), where the created sewing data, which is stored in the sewing data memory 14*c*, is written onto an FD inserted into the FDD 19 or a CD-R inserted into the CDD 21. While the option pull-down menu is displayed and if a button except for "Thread thickness", "Magnification rate", the image button K7, the save button and the end button, is specified (S5–S9: No), a process corresponding to the button which has been specified is performed (S15).

When the end button of the toolbar is specified using the mouse pointer M (S5–S8: No, S9: Yes), the CPU 12 executes the ending process such as clearing the option menu screen (S14), and the flow returns to S1. On the other hand, when a button other than option button K1 is specified from the toolbar on the sewing data making screen using the mouse pointer M (S3: No), a process corresponding to the button which has been specified is performed (S16).

Thus, the thickness of thread to be displayed is determined by the thread number to be used for actual sewing as set using the thread thickness setting dialog box and a magnification rate, to determine the image magnification, is determined using the magnification setting dialog box. Based on the determined thread thickness and magnification rate, the thread thickness for the sewing data to be displayed on the screen is calculated. Then stitches of the pattern with the calculated thickness are displayed as a realistic image screen. Therefore, the sewing patterns and embroidery patterns can be displayed on the CRT display in response to the texture and image to closely resemble those obtained when the pattern is actually sewn.

The default values of the thread thickness (No. 50) and the magnification rate (100%) are stored in the default memory 13*a* and the default memory 13*b* of the ROM 13. Because the default button K6 is allotted to both the thread thickness setting dialog box and the magnification setting dialog box, if the thread thickness or magnification rate is changed, it is easy to reset it to the default value using the default button K6.

For example, FIG. 13 is a realistic image of the pattern indicated in FIG. 6, which is magnified 180% on the sewing data making screen and then reset to the default (100%) in the realistic image display mode.

The operation of renewing the default values of the thread thickness and the magnification ratio will now be described.

First, the operator sets a desired thread thickness in the thread thickness dialogue box on the sewing data setting screen in accordance with the above procedure. When the operator specifies a set default button K16 on the display screen using the mouse pointer M, the value stored in the thread thickness memory 14*a* will be written into the default memory 13*a*, and it will replace the default previously stored in the default memory 13*a*. For example, if No. 20 is stored in the thread thickness memory 14*a* when the set default button K16 is specified, No. 20 is written into the default memory 13*a* and the default value of the thread thickness is renewed to No. 20.

Similarly, the operator sets a desired magnification rate in the magnification rate dialogue box on the sewing data setting screen in accordance with the above procedure. When the operator specifies the set default button K16 on this screen using the mouse pointer M, the value stored in the magnification rate memory 14*b* will be written into the default memory 13*b*, where it replaces the default previously stored in the default memory 13*b*. For example, if 150% is stored in the magnification rate memory 14*b* when the set default button K16 is specified, 150% is written into the default memory 13*b* and the default value of the magnification is renewed to 150%.

Thus, renewing of default values can be easily done by simply specifying the set default button K16 using the mouse pointer M in the thread thickness dialogue box or magnification rate dialogue box while the sewing data is being edited.

The sewing data processing program stored in the HD 17 can, alternately, be stored in a FD or CD-R and be run on a different sewing data processing apparatus by inserting the FD or CD-R storing the program thereinto. In this case, the FD and CD-R correspond to a program storage medium that stores the sewing data processing program of the invention. The storage medium may be another one, such as a RAM card, a CD-ROM, a ROM card, a DVD and a laser disk.

The thread thickness can be specified by inputting a diameter of a thread. The magnification rate can be specified with a ratio such as "1.5 times" and "2 times" instead of percentage. A magnification rate can be set for a specific part of a desired pattern only or for the entire sewing area. Every time the thread thickness or the magnification rate is determined, an image of the stitches of a pattern can be renewedly displayed according to the determined thread thickness or magnification rate. It should be understood that the sewing data processing apparatus of the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art. The invention can be applied to all sorts of sewing data making apparatuses including one embedded into the sewing machine.

In the above-described embodiment, sewing data is created by inputting each single point, however, it can be created based on the embroidery area data scanned by an image scanner.

In the above-described embodiment, the realistic image is displayed when the operator specifies the image button on the toolbar with the mouse pointer M while the operator inputs needle points. However, it can be renewedly displayed every time the operator inputs a point. Furthermore, it can be displayed only after the whole of sewing data is completely created. In the case where the realistic image is displayed only after the sewing data is completely created, the processing can be done in a higher speed because a point is not converted into sewing data immediately after it has been input. (Namely, data indicative of a sewing pattern is not converted to data indicative of a relative movement between a cloth and a needle.) In this arrangement, the default values of the thread thickness and the magnification rate may be read just before the sewing data conversion.

What is claimed is:

1. A sewing data processing apparatus, comprising:

a display;

a thread thickness selecting device that selects a thread thickness of a thread used for forming a sewing pattern;

a displaying magnification setting device that sets a displaying magnification of the sewing pattern on the display;

a calculating device that calculates a displaying size of the thread on the display based on the thread thickness selected by the thread thickness selecting device and the displaying magnification set by the displaying magnification setting device; and a display controller that displays the sewing pattern with the thread in the displaying size calculated by the calculating device on the display.

2. The sewing data processing apparatus according to claim 1, further comprising:

a default thickness storing device that stores a default thickness of the thread; and a thread thickness resetting device that resets a setting of the thread thickness to the default thickness of the thread stored in the default thickness storing device.

3. The sewing data processing apparatus according to claim 2, further comprising:

a default displaying magnification storing device that stores a default displaying magnification; and a displaying magnification resetting device that resets a setting of the displaying magnification of the thread to the default displaying magnification stored in the default displaying magnification storing device.

4. The sewing data processing apparatus according to claim 2, further comprising a default thickness setting device that sets the default thickness of the thread for the thickness of the thread used for the sewing pattern to be processed.

5. The sewing data processing apparatus according to claim 1, further comprising:

a default displaying magnification storing device that stores a default displaying magnification; and a displaying magnification resetting device that resets a setting of the displaying magnification of the thread to the default displaying magnification stored in the default displaying magnification storing device.

6. The sewing data processing apparatus according to claim 5, further comprising a default displaying magnification setting device that sets the default displaying magnification of the thread for the displaying magnification of the thread used for the sewing pattern to be processed.

7. The sewing data processing apparatus according to claim 1, wherein the displaying magnification setting device sets a displaying magnification of a desired sewing pattern.

8. The sewing data processing apparatus according to claim 1, wherein the displaying magnification setting device sets a displaying magnification of an entire sewing area.

9. A method of processing sewing data using an electronic processor and a display, comprising the steps of:

selecting a thread thickness of a thread used for forming a sewing pattern;

setting a displaying magnification of the sewing pattern on the display;

calculating a displaying size of the thread on the display based on the thread thickness and the displaying magnification; and displaying the sewing pattern with the thread in the calculated displaying size on the display.

10. The method according to claim 9, further comprising the steps of:

storing a default thickness of the thread in the electronic processor; and resetting a setting of the thread thickness to the default thickness of the thread stored in the electronic processor.

11. The method according to claim 10, further comprising the steps of:

storing a default displaying magnification; and resetting a setting of the displaying magnification of the thread to the default displaying magnification stored in the electronic processor.

12. The method according to claim 10, further comprising a step of setting the default thickness of the thread for the thickness of the thread used for the sewing pattern to be processed in the electronic processor.

13. The method according to claim 9, further comprising the steps of:

storing a default displaying magnification in the electronic processor; and resetting a setting of the displaying magnification of the thread in the electronic processor to the default displaying magnification stored in the electronic processor.

14. The method according to claim 13, further comprising a step of setting the default displaying magnification of the thread for the displaying magnification of the thread used for the sewing pattern to be processed in the electronic processor.

15. The method according to claim 9, wherein the step of setting the displaying magnification of the sewing pattern on the display sets a displaying magnification of a desired sewing pattern.

16. The method according to claim 9, wherein the step of the displaying magnification of the sewing pattern sets a displaying magnification of an entire sewing area.

17. A computer-readable storage medium that stores a sewing data processing program for processing sewing data using an electronic processor and a display, the sewing data processing program comprising:

a thread thickness selecting routine for selecting a thread thickness of a thread used for forming a sewing pattern;

a displaying magnification setting routine for setting a displaying magnification of the sewing pattern on the display;

a calculating routine for calculating a displaying size of the thread on the display based on the thread thickness and the displaying magnification; and a display controlling routine for displaying the sewing pattern with the thread in the calculated displaying size on the display.

18. The computer-readable storage medium according to claim 17, further comprising:

a default thickness storing routine for storing a default thickness of the thread in the electronic processor; and a thread thickness resetting routine for resetting a setting of the thread thickness to the default thickness of the thread stored in the electronic processor.

19. The computer-readable storage medium according to claim 18, further comprising:

a default displaying magnification storing routine for storing a default displaying magnification in the electronic processor; and a displaying magnification resetting routine for resetting a setting of the displaying magnification of the thread to the default displaying magnification stored in the electronic processor.

20. The computer-readable storage medium according to claim 18, further comprising a default thickness setting routine for setting the default thickness of the thread for the thickness of the thread used for the sewing pattern to be processed in the electronic processor.

21. The computer-readable storage medium according to claim 17, further comprising:

a default displaying magnification storing routine for storing a default displaying magnification in the electronic processor; and a displaying magnification resetting routine for resetting a setting of the displaying magnification of the thread in the electronic processor to the default displaying magnification stored in the electronic processor.

22. The computer-readable storage medium according to claim 21, further comprising a default displaying magnification setting routine for setting the default displaying magnification of the thread for the displaying magnification of the thread used for the sewing pattern to be processed in the electronic processor.

23. The computer-readable storage medium according to claim 17, wherein the displaying magnification setting routine sets a displaying magnification of a desired sewing pattern.

24. The computer-readable storage medium according to claim 17, wherein the displaying magnification setting routine sets a displaying magnification of an entire sewing area.

* * * * *